US006123017A

United States Patent [19]

Little et al.

[11] Patent Number: 6,123,017

[45] **Date of Patent: *Sep. 26, 2000**

[54] SYSTEM AND METHOD FOR EVALUATING THE FILL STATE OF A WASTE CONTAINER AND PREDICTING WHEN THE CONTAINER WILL BE FULL

[75] Inventors: Jonathan A. Little, Kalamazoo; Donald R. Schomisch, Shelbyville; Shaun W. Smith, Mattawan, all of Mich.

[73] Assignee: PMDS, L.L.C., Oxford, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/018,379

[22] Filed: Feb. 4, 1998

[51] Int. Cl.[7] ..... B30B 15/16; B30B 15/26

[52] U.S. Cl. ..... 100/35; 100/43; 100/50; 100/99; 100/229 A; 702/43; 702/140; 702/188

[58] Field of Search ..... 100/35, 43, 48, 100/50, 99, 229 A; 73/818; 364/138, 476.01; 702/43, 140, 188

[56] References Cited

U.S. PATENT DOCUMENTS

| | | | |
|---|---|---|---|
| 4,100,849 | 7/1978 | Pelton | 100/43 |
| 4,116,050 | 9/1978 | Tanahashi et al. | 100/99 |
| 4,195,563 | 4/1980 | Budraitis et al. | 100/50 |
| 4,603,625 | 8/1986 | Brown | 100/99 |
| 4,643,087 | 2/1987 | Fenner et al. | 100/35 |
| 4,773,027 | 9/1988 | Neumann | 100/50 |
| 4,787,308 | 11/1988 | Newsom et al. | 100/50 |
| 4,953,109 | 8/1990 | Burgis | 100/50 |
| 5,016,197 | 5/1991 | Neumann et al. | 100/50 |
| 5,173,866 | 12/1992 | Neumann et al. | 100/50 |
| 5,214,594 | 5/1993 | Tyler et al. | 100/229 A |
| 5,299,142 | 3/1994 | Brown et al. | 100/50 |
| 5,299,493 | 4/1994 | Durbin et al. | 100/50 |
| 5,303,642 | 4/1994 | Durbin et al. | 100/50 |
| 5,558,013 | 9/1996 | Blackstone, Jr. | 100/50 |

FOREIGN PATENT DOCUMENTS

| | | | |
|---|---|---|---|
| 2 695 346 | 3/1994 | France | 100/99 |
| 2087791 | 6/1982 | United Kingdom | 100/229 A |
| WO 97/40975 | 11/1997 | WIPO . | |

*Primary Examiner*—Stephen F. Gerrity
*Attorney, Agent, or Firm*—Flynn, Thiel, Boutell & Tanis, P.C.

[57] ABSTRACT

A system and method for determining the fullness of a large capacity waste container (20). Each time the a compactor (22) is used to compress the waste in the container a monitoring unit (24) determines the highest hydraulic pressure generated by the compactor during a selected period of compactor use. The monitoring unit also maintains a count of how often the compactor is used. After the container is filled and emptied a number of times, the monitoring unit then divides the highest hydraulic pressures for the uses by the number of uses to obtain a pressure/use value. This pressure/use value is used as a variable to determine a maximum uses value representative of the number of times the compactor can be used before a container is filled. Once a container data representative of how full a container is, and how many compactor uses remain, is calculated by comparing the number of times the container has been used since it was emptied to the maximum uses value. The system can also forecast when, at a time in the future, the container will be filled.

38 Claims, 5 Drawing Sheets

FIG. 15

| | S | M | T | W | Th | F | Sa |
|---|---|---|---|---|---|---|---|
| DAILY USES | 3 | 8 | 16 | 11 | 20 | 9 | 4 |
| | 5 | 8 | 13 | 15 | 14 | 8 | 4 |
| | 7 | 9 | 15 | 8 | 18 | 12 | 7 |
| | 4 | 8 | 14 | 11 | 13 | 10 | 4 |
| EXPECTED USE | 5 | 8 | 15 | 12 | 16 | 10 | 5 |

SYSTEM AND METHOD FOR EVALUATING THE FILL STATE OF A WASTE CONTAINER AND PREDICTING WHEN THE CONTAINER WILL BE FULL

FIELD OF THE INVENTION

This invention is directed generally to a monitoring system for predicting the fullness of a waste container and, more particularly, to a monitoring unit that both provides an indication of the current fullness of a waste container and an indication of when, at a time in the future, the container will be filled.

BACKGROUND OF THE INVENTION

A byproduct of many human activities is the generation of solid waste. In many industrial, commercial and large scale residential facilities, this waste is placed in large containers that have capacities of at least 30 $yd^3$. Once one of these containers is filled, a hauler transports the container to a landfill or other disposal site. Typically, when a hauler goes to site, it brings a new, empty waste container to replace the filled container.

At many facilities at which a waste container is located, a compacting unit is employed to compress the waste that fills the container. Clearly, compacting the waste reduces the frequency with which the container needs to be emptied. Also, at many landfills and other disposal sites, the charges to empty a container are a function of container volume. It is in the best interests of the hauler unloading the container to have as much waste as possible packed into the container before it is transported to these sites for emptying. Most compacting units include some type of ram that, when actuated, projects into the container to compress the waste. Most rams are hydraulically actuated. Some compactors have rams that are automatically controlled. These compactors are designed so that the time period for which the ram is allowed to extend is preset. Other compactors have manually controllable rams. These compactors allow the individual using the compactor to control the time the ram is allowed to extend each time the ram is extended.

It is often the responsibility of the hauler to remove and replace a filled waste container without any prompting from the business at which the container is located. At these facilities, the containers are typically picked up on a scheduled basis. At other facilities, the hauler removes the filled container on a "will call" basis. At these facilities, the facility operators usually prompt the hauler in order to have the filled containers removed. As discussed above, the economics of waste transport and processing dictate that a container should not be removed from a facility until it is substantially full. Accordingly, a number of systems have recently been developed that provide indications of the fill state of a waste container. Some of these systems operate by monitoring the pressure of the hydraulic fluid that actuates the ram which compresses the waste. These systems generate an indicia of container fullness based on the principle that, as the container is filled, the pressure of this fluid increases in order to provide the force needed to compress the waste. Other systems monitor the number of times the compacting ram is actuated after an empty container is placed at a facility. These systems provide an indication of container fullness based on the assumption that container fullness is directly related to ram use. Some systems monitor first one and then a second one of the above parameters to provide different indica of the container fullness.

Regardless of the actual algorithm employed to determine container fullness, most monitoring systems have some type of data transmission components. These transmission components transmit the data from the waste container to a central location, typically the hauler's dispatcher's office. This data can be the raw data generated by transducers integral with the compactor and/or processed data including the indication of container fullness. The dispatcher evaluates this data to determine the fullness of the individual containers. Based on these evaluations, the dispatcher schedules the pick-up and replacement of the individual containers.

While current systems for determining container fullness offer some indication of container fullness, it has been found that the data they generate is sometimes lacking in precision. This is because variations in each actuation of a compactor can significantly skew the resultant determination of container fullness. These variations occur because, at most facilities, different people tend to the loading of the container and control the actuation of the compactor. Accordingly, if one person, whether out of caution or boredom, frequently actuates the compactor, a use-based determination of container fullness may indicate a container is substantially full when, in fact, that is not the case. At another facility, an individual with responsibility for filing a compactor may actuate the compactor at less frequent basis than his/her coworkers. If the compactor is provided with a pressure-based system for evaluating container fullness, the data generated during this individual's uses can likewise produce an indication of fullness that is incorrect. Also, with a manually operated compactor, the time periods the ram is actuated may significantly vary depending with the individuals tending the container. These variations can adversely effect the accuracy of both use-based and pressure-based calculations of container fullness.

There have been some attempts to compensate for these individual variations in compactor use. For example, some systems are designed to provide an indication of compactor fullness based on average pressure or discard some high pressure readings. While these systems may offer some improved accuracy, they still can generate inaccurate indications of container fullness in some situations.

Moreover, many waste haulers would like to know more than the extent to which their containers are full. It is very helpful if a hauler can be provided with an indication of when, at a time in the future, a particularly container is expected to be completely full. If a waste hauler has this forecast, it can then schedule the pick-up and replacement of the container to occur at a time just before the container is full. Such scheduling accomplishes two goals. First, this scheduling minimizes the pick-up costs since the number of times the container is picked up and emptied is kept to a minimum. Secondly this scheduled reduces, if not eliminates the situation arising in which the container is completely filled and the waste-generator must find another, temporary location for the waste until the new container is delivered.

A system for forecasting when a waste container will be full is disclosed in PCT Publication No. WO 97/40 975, based on PCT Application No. PCT/US97/06779, filed April 29, 1997, which is incorporated herein by reference. The system disclosed in this document generates a database of the number of times per time period, (day-of-week, shift-of-work) a compactor is employed to compress the waste in a container. The system also generates an indication of number of remaining times a compactor can be employed to compress the waste in a container. Once the system calculates this intermediate data, it generates a forecast of the time period in future during which the container will be full. While this system has been used with some success, this success has been limited. This is because, for the reasons discussed above, it has been difficult to provide an accurate indication of container fullness. Consequently, it has been equally difficult to provide an accurate forecast of the number of times the compactor can be used in the future before the container will be filled. Since this latter variable has proven difficult to accurately generate, the ability to predict when, in the future, a container will be full has similarly proved difficult to accurately forecast.

SUMMARY OF THE INVENTION

This invention is directed to a new and useful system and method for determining the fullness of a waste container in which stored waste is compacted. This invention is further directed to a system and method that uses this calculated measure of container fullness as a variable to forecast when, at a time in the future, the container will be full.

This invention includes transducers and sensors that monitor the operation of the trash compactor that compresses the waste placed in the container. These transducers and sensors collectively monitor the on/off state of the motor that energizes the hydraulic pump, the pressure of the hydraulic fluid that actuates the ram and the motion of the ram. Another transducer generates signals indicating when a full container is removed from a facility and a new, empty, container is installed. The data generated by these transducers is supplied to a processing unit. In some preferred versions of this invention, the processing unit is a programmable logic controller.

More particularly, with regard to hydraulic pressure measurements, the processing unit only records the pressure sensed during the primary extension period of each compaction stroke. The data generated by the pressure transducer during the initial and final extension periods of the compression stroke is not processed. The data acquired over a number of compaction strokes is averaged to generate an average maximum compaction pressure.

Over time, this processing unit generates data regarding the use history of the container. When a full container is removed from a facility, the processing unit calculates a pressure/use value based on the calculated average maximum compaction pressure and the number of times the compactor was used, was actuated. Over time, a pressure/use average value is calculated. This figure is then used as a variable to determine the maximum number of times the compactor can be used before the container is full, the maximum uses of the container.

Once the processing unit determines the container's maximum uses, it is able to generate an indication of container fullness. This calculation is performed by comparing the number of times the container was used since it was installed empty to the calculated maximum uses value. Also, the average maximum pressure is compared to the maximum pressure the hydraulic ram is allowed to develop. These comparisons are averaged to yield an indication of the fullness. The first comparison is also used to develop an estimation of the number of uses remaining before the container will be filled. This later result is then used as an input variable upon a prediction of when, in the future, the container will be full.

The system and method of monitoring container fullness of this invention only processes the hydraulic pressure data during a select period of time during which the hydraulic ram is actuated. This selective processing prevents the system from processing data that may erroneously skew the subsequent calculations. In versions of this invention used with manually actuated rams, the system also performs adjustments to reset the window of time in which it processes the hydraulic data. This feature of the invention compensates for individual styles of ram actuation.

The determination of the maximum uses of the container is based on both the hydraulic pressures required to compress the waste and a count of the number of times the container is used. By basing the maximum uses value on both these variables, the maximum use value can be determined with relative accuracy. Consequently, the subsequent data generated by the system, the number of uses remaining and the forecast of when the container will be fill, are likewise generated with a significant degree of dependability.

Moreover, each time the container is removed from the site, the maximum uses of the container is recalculated. The constant recalculation of this value ensures that it remains as accurate as possible estimation of container use even if the use patterns of the trash compactor change.

BRIEF DESCRIPTION OF THE DRAWINGS

The invention is pointed out with particularity in the claims. The above and further features of this invention may be better understood by reference to the following description taken in conjunction with the accompanying drawings, in which:

FIG. 15 is a representation of how the processing unit generates a table indicating how often the compactor is used in a given secondary time period.

DETAILED DESCRIPTION

Figure 1:
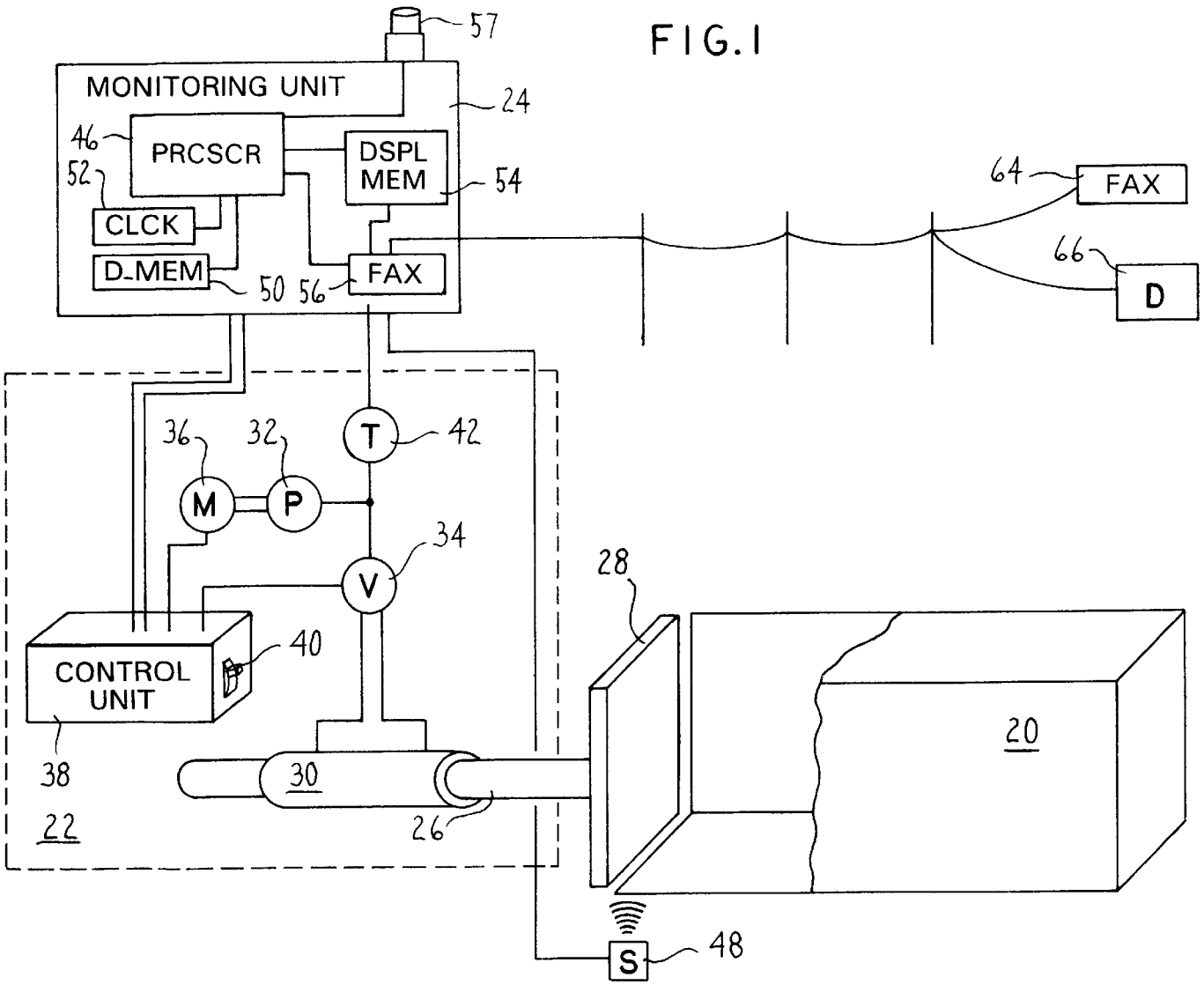
FIG. 1 is a block diagram of the basic components of the waste container monitoring system of this invention.

FIG. 1 is block diagram representing a waste container 20, a compactor 22 that compresses the waste in the container and a monitoring unit 24 incorporating the system of this invention for monitoring the fullness of the container. The waste container 20 is an elongated container for storing compacted solid waste. A waste container typically has a capacity between 30 and 85 $yd^3$. The compactor 22 has a ram 26 that is selectively actuated in order to compress the waste in the container 20. The ram 26, which is a hydraulically driven piston, has a head end to which compaction plate 28 is attached. When the ram 26 is actuated, the compaction plate 28 extends through an open end of the container 20 to compress the waste therein. The base end of the ram 26 is seated in a cylinder housing 30. Hydraulic fluid is selectively supplied to and removed from the opposed ends of the cylinder housing 30 in order to cause the extension and retraction of the ram 26.

The pressurized hydraulic fluid is supplied to cylinder housing 30 from a pump 32, also part of the compactor 22. The flow of the hydraulic fluid to the cylinder housing 30 is controlled by a valve 34. The pump 32 is energized by a complementary motor 36. A control unit 38, also integral with the compactor 22, regulates its operation in response to the actuation of user set switches 40. In particular, control unit 38 regulates the actuation of motor 36 and the setting of valve 34 in order to control when the ram 26 is extended and retracted.

Some compactors 22 are manually operated. These compactors are designed so that the user can control the length of time their associated rams 26 are allowed to be extended. Some compactors 22 are essentially completely automated, once the user depresses an appropriate switch 40, these compactors cause their rams 26 to extend for set periods of time and then to retract. Some automated compactors 22 are further configured so that each time they are actuated, their complementary rams 26 are extended and retracted for multiple cycles. Often this type of compactor 26 is configured so that each time it is actuated, the associated ram 26 is extended and retracted at least three times.

One compactor 22 that can be employed to compress waste in a container 20 is the Model No. CP-4002 compactor manufactured by SP Industries, Inc. of Hopkins, Mich. This compactor 22 can be configured for either automatic or manual control of its ram 26.

Integral with the compactor 22 is a pressure transducer 42. The pressure transducer 42 is connected to branch line of the output port of pump 32. In some constructions of this invention, the pressure transducer 42 is connected to an outlet port in fluid communication with the side of the hydraulic system through which the hydraulic fluid required to extend the ram 26 flows. The pressure transducer generates a signal representative of the pressure of the hydraulic fluid applied to the ram 26 in order to cause the extension of the ram. In many compactors 22 the pressure developed is between 0 and 2500 psi depending on the fill state of the container 20. More commonly, the hydraulic pressure is between 0 and 1500 psi.

The monitoring unit 24 employing the system of this invention includes a processor 46 that processes data based on a set of programmed instructions, (program memory not shown). The processor 46 receives data from the compactor 22 regarding the operation of the compactor. In particular, the processor 46 receives data from the control unit 38 indicating: the motor on/off state; if the motor is overloaded; and if the ram is in a static state, being extended or being retracted. The processor 46 also receives the signals from the transducer 42 representative of the sensed hydraulic pressure. While the above-described signals from the control unit 38, the transducer 42 and the container-state sensor 48 are all forwarded to processor 46, to minimize the complexity of FIG. 1, only the connections to monitoring unit 24 are depicted.

Additional data is provided to processor 46 from a container-state sensor 48. The sensor 48 generates a signal indicating whether or not a waste container 20 is connected to the compactor 22. Some sensors 48 are optical sensors that monitor the reflection from a light beam. Other sensors are plunger-type switch sensors. In some waste compacting systems, the container-state sensor 48 is part of compactor 22. In other waste compacting systems, the container-state sensor 48 is a stand-alone component.

The monitoring unit 24 also includes a data memory (D_MEM) 50 in which data received by and generated by the processor 46 are stored. A clock 52 provides an indication of the real time to the processor 46. A display memory 54 stores data that defines images that can be presented for viewing. A facsimile unit 56 internal to the monitoring unit generates signals containing the image-defining data. The processor 46 controls the forwarding of the image-defining data from display memory 54 to facsimile unit 56. The processor 46 also controls the facsimile unit 56 to regulate when and to where the facsimile unit transmits data.

While the processor 46, data memory 50, clock 52 and display memory 54 of the monitoring unit 24 are shown as discrete components, it should be recognized that this is not always the case. In some versions of the invention, these components may be within a single module. For example these components may be contained within a programmable logic controller such as the Model No. IC693UDR005FP11 sold by GE Fanuc Automation North America, Inc. of Charlottesville, Va.

The monitoring unit 24 is also show as having a strobe 57. Strobe 57 is selectively actuated by processor 46 whenever a particular fault state exists. For example, the strobe 57 may be actuated when it is determined that the waste container 20 is full, excessive current has been applied to the motor 36, or the ram 26 has failed to retract. The actuation of the strobe 57 provides an indication to the persons that normally tend the waste container 20 and compactor 22 that a fault condition has occurred that requires attention.

The monitoring unit 24 monitors the state of the waste container 20 and compactor 24. Some of the fault states for which the monitoring unit 24 can generate information are states that can readily be detected by monitoring the state signals generated by the compactor control unit 38. The state of these signals provides a ready indication of whether or not the motor 36 is overloaded and whether or not the ram 26 did successfully extend and retract. If these signals indicate that a fault occurred, processor 46, in turn, loads data defining an appropriate image from display memory 54 into the facsimile unit 56. More particularly, this data defines an image that presents information that identifies the container 20/compactor 22 at which the fault occurred nature of the fault requiring attention. Once the image-defining data is loaded, the processor 46 directs the facsimile unit 56 to send the data to an appropriate end location, typically the dispatch office of the hauler. At the dispatch office, either a facsimile report will be generated over a facsimile machine 64 or an image will be presented on a display terminal 66. Supervisory persons charged with the maintenance of the waste container 20 and compactor 24 are thus made aware of the fault so that they can take appropriate action.

The monitoring unit 24 also provides an indication of the fullness of container 20. The monitoring unit 26 provides this information by monitoring two basic variables, the pressure developed by the hydraulic fluid that extends the ram 26 and the number of times the ram is actuated, used, since the empty container 20 was installed.

Figure 2:
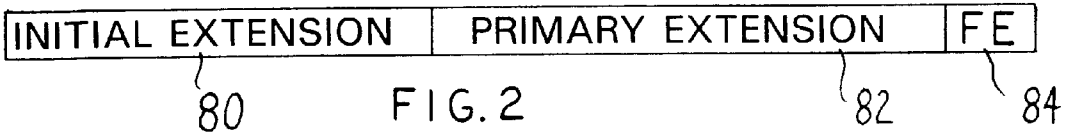
FIG. 2 is a diagrammatic representation of the different portions of the extension stroke during which the ram compresses the waste in the container.
Figure 10:
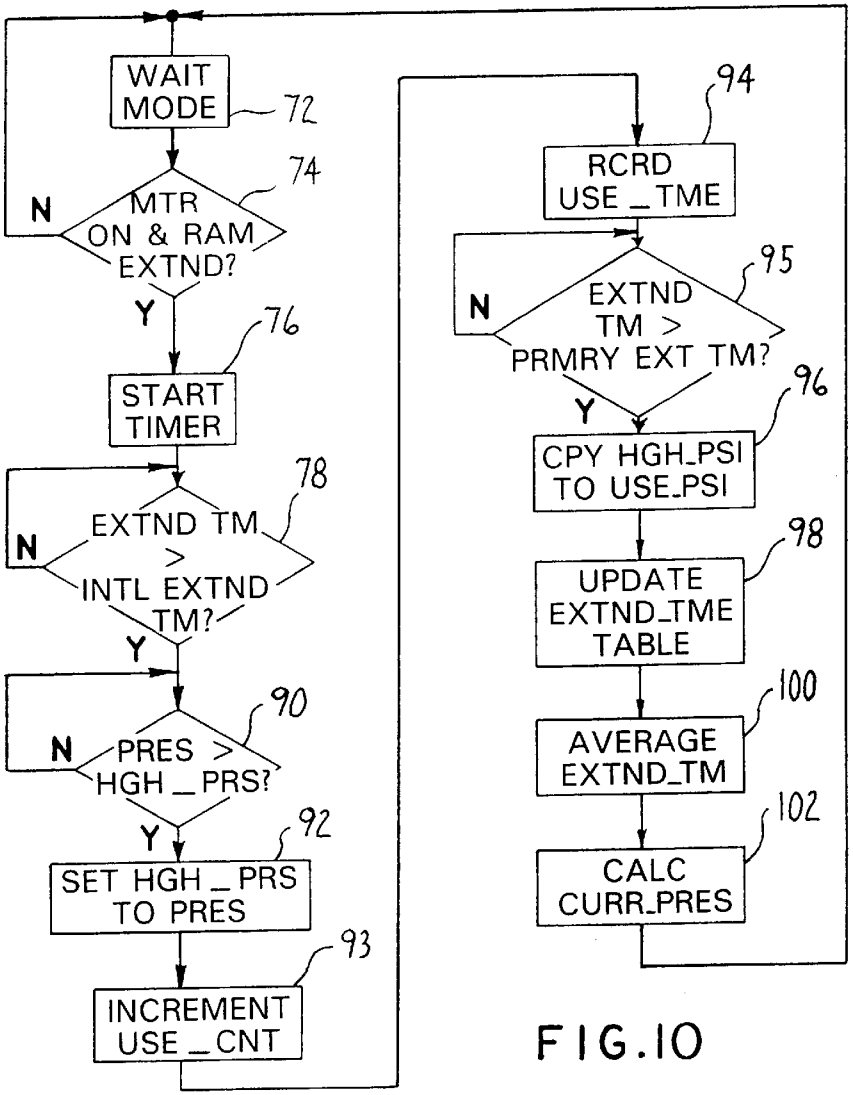
FIG. 10 is a flowchart illustrating how the processing unit selects received pressure data for subsequent processing.

An explanation how the processor 46 selects hydraulic pressure data for subsequent processing is now set forth by reference to FIGS. 2 and 10. Normally, the processor 46 is in a wait mode represented by step 72 of FIG. 10. Periodically, while in the wait mode 72, the processor checks the state of the status lines from the compactor control unit 38 to determine if the motor 36 has been actuated and if the ram 26 is extending as represented by step 74. If these events are not occurring, the processor 46 returns to the wait mode. Once these events occur, the processor 46 initiates an internal timer, step 76, which is initially set to zero. As long as the processor 46 receives signals indicating the ram 26 is being extended, it periodically checks the internal timer, step 78. This polling is done to determine if the ram has been extended for more than initial extension period 80, depicted in the time graph of FIG. 2. Typically this initial extension period 80 is the initial 20% to 40% of the total time period in which the ram 26 is extended. More particularly, the initial extension period 80 is approximately 33% of the total time period of ram extension.

If the compactor 22 has an automatically controlled ram 26, the time period for the initial extension period 80 is typically preset. If the compactor 22 has a manually controlled ram 26, the time period for the initial extension period may still be a preset, fixed time. Alternatively, the time period for the initial extension period 80 may be based on a preset coefficient and an expected extend time variable. This latter variable is an estimate of the expected extend time for the ram 26. The processes steps by which this variable is calculated are discussed below.

If, in step 78, it is determined that the ram 26 is still engaging in the initial extension period 80, processor 46 does not do any subsequent processing of the signals it receives from transducer 42. If the ram extension stops before the end of the initial extend time period 80, the processor 46 returns to the wait mode 72, connection not shown, and there is no further processing of the data acquired during this particular actuation of the compactor 22.

Figure 4:
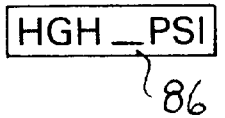
FIG. 4 is a representation of the field internal to the processing unit in which data representative of the last measured maximum pressure is stored.

Once the initial extension period 80 is completed, the ram 26 enters what is referred to as a primary extension period 82. Once the ram 26 enters the primary extension period 82, processor 46 engages in a test-and-store sequence of the hydraulic pressure signals represented by steps 90 and 92. After the initial transducer signal is stored, step not illustrated, in step 90 processor 46 compares each signal from transducer 42 to determine if, for that primary extension period 82, the hydraulic fluid pressure is at a maximum. Each time a determination is made that the hydraulic pressure is at a maximum, greater than the last stored maximum, the pressure is stored in step 92. More particularly, the data representative of maximum pressure is stored in a highest pressure (HGH_PSI) field 86 (FIG. 4) in the data memory 50.

Figure 5:
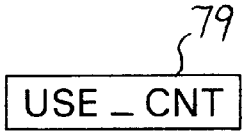
FIG. 5 is a representation of the field internal to the processing unit in which data representative of the use count of the trash compactor is stored.

Also, once the ram 26 enters the primary extension period 82, processor 46, in step 93 increments by one the value stored in a use count (USE_CNT) field 79 (FIG. 5) in data memory 50. The use count field 79 contains a count of the number of times the ram 26 has been actuated since the empty waste container 20 was placed on site. It should be understood that the count in the use count field 79 is zeroed by processor 46 each time the signals from sensor 48 indicate the container is replaced, emptied (zeroing step not shown).

Figure 6:
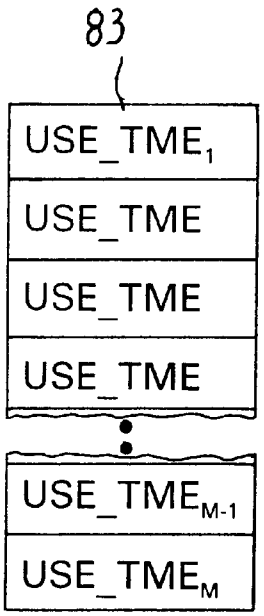
FIG. 6 is a representation of the file table internal to the processing unit in which data representative of when the compactor was used is stored.

Processor 46 also records the time and date of the use of the compactor 22 as represented by step 94. The processor determines the time of this event by reference to clock 52. The time the compactor is used is recorded in a USE_TME table 83 (FIG. 6). As will be described hereinafter, the data in the USE_TME table 83 is used as a basis for predicting when, in the future, the container 20 will be full.

The processor 46 also continues to monitor how long the ram 26 extends as depicted by step 95. Once the ram 26 extends for a select amount of time, the ram is considered to be in the final extension period 84 (FIG. 2). Typically this final extension period 84 of time is the last 5 to 20% of the total time of ram extension. More specifically the final extension period 84 is approximately the last 10% of the total time of the ram extension.

In monitoring units 24 employed with automatically controlled rams, the time point from initial ram extension at which the ram 26 is considered to enter the final extension period 84 is preset. In monitoring units with manually controlled rams 26, the time point at which the ram is considered to enter the final extension period is based on a fixed coefficient and the calculated expected extend time variable.

Figure 3:
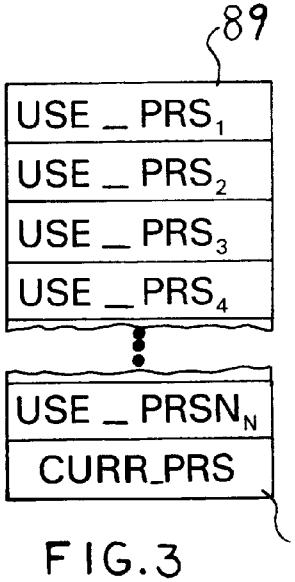
FIG. 3 is a representation of the file table internal to the processing unit in which data representing the highest measured hydraulic pressure is stored.

Once the ram 26 enters the final extension period 84, the processor 46 stops analyzing the received signals from the transducer 42. The data representative of the highest measured pressure during the primary extension period 82 of the ram stored in high pressure field is copied from HGH_PRS field 86 into a FIFO buffer represented by table 89 (FIG. 3), step 96. Table 89 contains data representative of the highest pressures measured for a number of the previous uses actuations of the compactor 22. In table 89, the pressure data for the individual compactor actuations is represented as $USE_PRS_1$, $USE_PRS_2$, . . . $USE_PRS_N$, respectively. In some versions of the invention, the table 89, the USE_PRS table, contains data representative of the highest measured pressures for the last 15 uses of the compactor 22. Once the USE_PRS table 89 is full, the oldest data in the table is discarded. The subsequent processing of the USE_PRS data will be discussed hereinafter.

Figure 7:
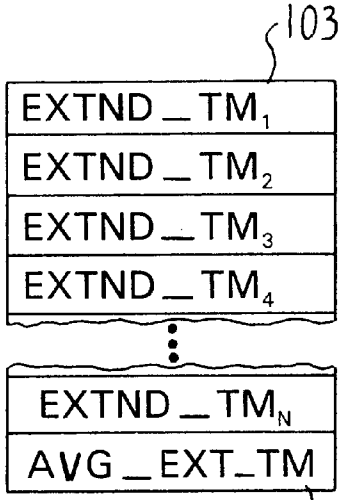
FIG. 7 is a representation of the file table internal to the processing unit in which data representative of the time period of ram extension is stored.

If the compactor 22 is a manually operated compactor, the processor 46, by monitoring the internally set timer, determines the total time period for which the operator extended the ram, step 98. The length of this time period is placed in a FIFO buffer represented by table 103 (FIG. 7). In table 103 the individual entries representative of ram extend time are depicted as $EXTND_TM_1$, $EXTND\text{-}TM_2$, . . . $EXTND\text{-}TM_N$, respectively.

Once the data in table 103 is updated, the data in the table is averaged in a step 100. The next time the compactor 22 is actuated, the expected extend time of the compactor is set equal to this averaged extend time value. This AVG_EXT_TM value is stored in a field 103*a* shown as integral with EXT_TM table 103. The next time the compactor 22 is actuated, the end of the primary extension period 82 of the ram 26 is calculated based on this immediate past average extend time of the ram 26. This recalculation of the end of the primary extension period 82 compensates for the fact that the persons controlling the ram may cause it to extend for varying amounts of time.

In versions of the monitoring unit 26 of this invention used with compactors 22 that automatically control ram extension steps 98 and 100 may not be executed. Also, some compactors 22 are configured so that each time the waste in the container 20 is to be compressed, the ram 26 automatically engages in multiple extension and retraction cycles in a relatively short period of time. In monitoring units 24 employed with these compactors 22, the processor 46 often only analyzes the hydraulic pressure readings obtained during a single extension of the ram 26. Typically, the processor 46 only analyzes the readings obtained during the last extension of the ram 26.

Once the data in the USE_PRS table 89 is updated, the processor 46, then calculates a current pressure (CURR_PSI) for the container in step 102. This calculation is performed by averaging the last "x" USE_PRS values stored in USE_PRS table 89. Typically "x" is the last 5, 10 or 15 highest detected pressures during use values for the ram 26. However, "x" may be any number of past pressure values that are deemed useful for generating a current high pressure value for the container 20. The calculated current pressure value is then stored in the data memory 50. For the purposes of illustration, the current pressure value is shown stored in a CURR_PRS field 89*a* integral with USE_PRS table 89.

Once step 102 is executed, the processor returns to the wait mode 72 until it detects the compactor 22 is again actuated.

Figure 8:
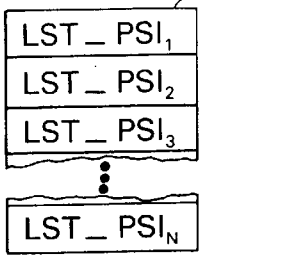
FIG. 8 is a representation of the file table internal to the processing unit in which data representative of the last pressures for the last set of pulled containers is stored.
Figure 9:
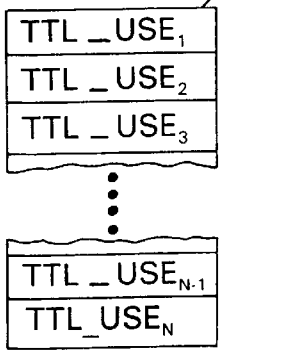
FIG. 9 is a representation of the file table internal to the processing unit in which data representative of the use counts for the last set of pulled containers is stored.
Figure 11:
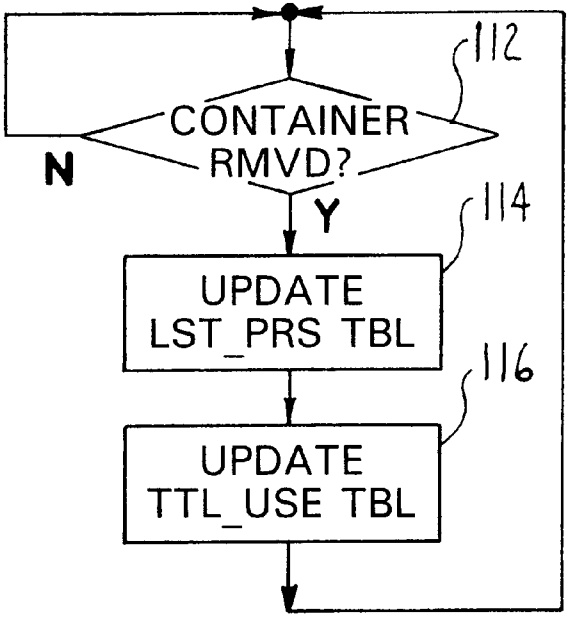
FIG. 11 is a flowchart illustrating how data is updated when a container at a facility is removed and replaced.

The container 20 is, over time, filled with waste and eventually removed. The processor 46 receives an indication of when a full container 20 is removed and an empty container installed by monitoring the state of signal produced by sensor 48. This step is depicted by monitoring step 112 of FIG. 11. Once the processor 46 receives this indication, it updates other internal tables that provide historical data about the use of containers 20 at the facility at which monitoring unit 24 is installed. In step, 114 the data in the CURR_PRS field 89*a* is copied into a FIFO buffer in which data representing the current hydraulic pressures immediately prior to the container being removed for the last N removals of the container are stored. This FIFO buffer is represented as last LST_PRS table 104 (FIG. 8). In step 116, the data in USE_CNT field 79 representative of the total number of times the compactor 22 was used prior to container removal 20 is copied into another FIFO buffer. This FIFO buffer, represented as TTL_USE table 106, (FIG. 9) stores a record of the number of times the compactor 22 was used between when an empty container was delivered and the full container removed. Steps 114 and 116 are not executed again until, in step 112 there is another indication that the container 20 was removed and a new container installed.

After a filled container 20 at a facility has been replaced a number of times, the monitoring unit 24 will have stored sufficient historical data to generate data representative of container fullness. Prior to the acquisition of this historical data, some of the values discussed below may simply be estimated based on past use histories for similar containers employed at similar facilities.

Figure 12:
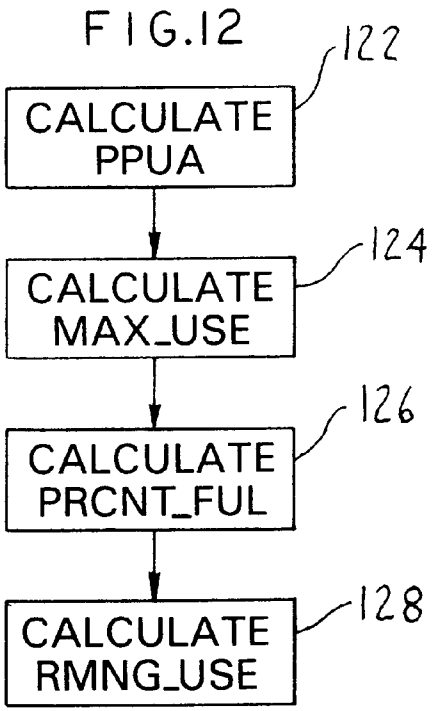
FIG. 12 is a flowchart illustrating how data characterizing the fullness of a container and the remaining uses of the container is calculated according to the system and method of this invention.

The process by which the monitoring unit 24 generates data representative of container fullness is now described by reference to the flowchart of FIG. 12. While the process steps described in this flowchart are shown as occurring consecutively, it should be understood that that is not always the case. Some process steps only occur after a container 20 is removed from a facility. Other process steps occur after a compactor 22 is actuated. Moreover, in some versions of the invention, the monitoring unit 24 may only execute some processing steps, those immediately required to generate the container fullness data, in response to command from an external device. For instance, a dispatcher at a center location may, using an appropriate digital processing device, direct the monitoring unit 24 to provide him/her with an indication of container fullness.

Initially, as represented by step 122, the processor generates a pressure/use average (PPUA) for the container. This step 122 is executed soon after a full container 20 has been removed from a facility and a new container installed. The processor executes step 122 by summing the last "x" pressure values in LST_PRS table 104. The last "x" container use values recorded in the TTL_USE table 106 are also summed. In many versions of the invention, "x" is 5, 10, or 15. Thus, the pressure and use count data from the last 5, 10, or 15 complete fills of the container 20 is used to calculate the PPUA. It should, of course, be recognized that data from different numbers of last complete fills may be used.

Once the pressure and use count values are summed, the following formula is used to calculate PPUA:

$$PPUA=\Sigma LST_PRS/\Sigma TTL_USE$$

Figure 13:
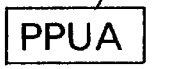
FIG. 13 is a representation of the field internal to the processing unit in which data representative of the pressure/use of the container is stored.

Once the PPUA is calculated, it is stored in a dedicated field 107, (FIG. 13), storage step not shown.

After the PPUA is calculated and stored, in step 124 maximum uses (MAXUSE) for the container is calculated. The MAXUSE value is calculated according to the formula:

$$MAXUSE=PSIMAX/PPUA$$

Figure 14:
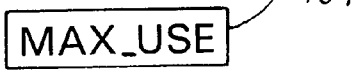
FIG. 14 is a representation of the field internal to the processing unit in which data representative of the maximum uses of the container is stored.

Here, PSIMAX is a constant, the maximum pressure that the hydraulic fluid employed to actuate the ram 26 is allowed to generate when the ram is employed to compress the waste in the container 20. The constant PSIMAX is based on the characteristics of the container 20 and the compactor 22. Values of PSIMAX range between 1000 and 2500 psi; a more common value is approximately 1500 psi. The MAXUSE value is stored in a MAXUSE field 109 (FIG. 14) in data memory 50 so it can be used as a variable in other calculations.

After the MAXUSE value has been calculated, monitoring unit 24 is able to generate data representative of container fullness (PRCNT_FULL), step 126. This value is calculated by first calculating the percentage fullness of the container by use according to the formula:

$$PRCNT_FULL_{USE}=USE_CNT/MAXUSE$$

Container fullness according to pressure is then calculated according to the formula:

$$PRCNT_FULL_{PRS}=CURR_PRS/PSIMAX$$

Then, in step 126, the $PRCNT_FULL_{USE}$ and $PRCNT_FULL_{PRS}$ values are averaged. This averaged value is the PRCNT_FULL value of the container 20 that is generated by the monitoring unit 24.

In a step 128, processor generates a count of the remaining uses (RMNG_USE) by use of the following formula:

$$RMNG_USE=MAXUSE-USE_CNT$$

Based on the calculated PRCNT_FULL and RMNG_USE values, the monitoring unit 24 may take particular additional steps. For example, the processor may be programmed to cause a particular facsimile message to be generated whenever the container reaches a particular fullness level or there are less than a given number of uses of the container 20 remaining. Alternatively, at some fullness levels/remaining use levels, the monitoring unit may actuate the strobe 57 to generate local attention about its pending complete fullness.

The monitoring unit 24 is also capable of providing a forecast of when, at a time in the future, the waste container 20 will be full and require emptying. This process starts with the recording of the time and date of when the compactor 22 is used in step 94.

After the container 20 has been at facility for an extended period of time, uses per period data, depicted in FIG. 15 can be developed. This data represents how often, over definable primary periods of time, the compactor 22 is used during each of a number of secondary periods of time. This data is generated from the compactor use data stored in USE_TME table 83. Collectively, these secondary periods of time form a single primary time period. For example, if the length of time is a week; the secondary periods can be individual days. At other facilities, the secondary periods may be hours, manufacturing shifts or production cycles. For each identifiable secondary period, (day, hour or shift) a count is maintained of the number of times the compactor 22 was actually used. After this data each sub-period, it is averaged in order to find an average use for that sub period. In the example of FIG. 15, the data reveals that the compactor is used, on the average 15 times of Tuesday.

After the processor 46 calculates the average uses for each sub-period, it is then able to forecast, when at a time in the future the container will be full. The processor 46 performs this function by counting down from the remaining uses of the counter the expected uses of the container secondary period by secondary period. If for example, at the end of the day on Monday, the calculation reveals in step 128 that there are an expected 35 remaining uses of the container, then processor 46 executes the following steps to determine when the container is expected to be full:

| | |
|---|---|
| 35 | Remaining Uses |
| −15 | Expected Uses On Tuesday |
| 20 | Intermediate Remainder |
| −12 | Expected Uses On Wednesday |
| 8 | Intermediate Remainder |
| −16 | Expected Uses On Thursday |
| No More Remaining Uses | |

Thus, in this example, the processor 46 determines that the container 20 will most likely be full after a few hours of use on Thursday. Depending on the configuration of the monitoring unit 24, this information could be transmitted to the dispatcher.

Alternatively, the determination that container 20 will be full at a particular time in the future is used by the monitoring unit 24 as a flag to cause the announcement of this estimation to be sent to the dispatcher. The monitoring unit 24 may be programmed so that when it expects to be full within a given time, for example 72 hours, it will send an appropriate message to the dispatcher. This message could be a report of its current fullness and/or an indication of when, in the future, it will be completely full. Based on the receipt of this data, the dispatcher can then schedule a hauler to pick up the container at the time it is expected to be completely full.

The monitoring unit 24 bases its analysis of container 20 fullness on three basic variables, the hydraulic pressure, the force required to compress the waste in the container, the number of times the container has been used since it was emptied and the most recent history of container use.

More particularly, the monitoring unit only analyzes the hydraulic pressure developed during the primary extension period 82 of the ram 26. The pressure developed during the initial extension period 80 and the final extension period 84 is not analyzed. By not analyzing the pressure developed in the initial extension period 80, the monitoring unit 24 avoids basing a calculation of container fullness on data generated as a result of an incomplete compression of the waste. This event can occur if an individual operating a manually set compactor 22 does not extend the ram 26 for a normal amount of time. By not analyzing the pressure developed in the final extension period 86 of the ram 26, the monitoring unit 24 does not generate data indicating container fullness based on high-pressure spikes that often occur during the final extension of the ram 26. Thus, the pressure variable upon which the monitoring unit 24 of this invention basis its generation of container fullness is an average pressure that was developed during the central, primary, extension of the ram 26. This variable is not skewed by either excessively low or high pressures that may occur during either the initial or final extension of the ram 26.

The use history variables upon which the monitoring unit 24 bases its generations of container fullness data are constantly updated to reflect any changing patterns of container use. Thus, when the algorithm to generate container use is actually executed, the end result is based on both variables that accurately reflect the current state of the container and its immediate past use. The use of these variables ensures that the data generated by the monitoring unit 24 provides both a relatively accurate estimate of container fullness and of the remaining uses left before the container is completely full.

Given the ability of the monitoring unit 24 to generate data accurately estimating the remaining uses of the container, the monitoring unit is then able to generate data estimating when, in the future, the container will be essentially full.

The ability of the monitoring unit to provide this data estimating container fullness, remaining uses, and expected full time facilities efficient scheduling of the removal of the container 20. Specifically, once the dispatcher is provided with this data, the dispatcher can then schedule the removal of the container 20 at a time when it is closest to being filled. This scheduling minimizes the number of times the container needs to be emptied so as to reduce the overall costs associated with maintaining the container.

It should be recognized that the foregoing description is limited to one particular version of the system of this invention. It will be apparent, however, that variations and modifications can be made to this invention with the attainment of some or all of the advantages thereof. Clearly, one of the simplest modifications is to configure this invention so that all the monitoring unit 24 does is forward the hydraulic pressure, use and container pull data to a processor in the office of the dispatcher. This central processor can then, in turn, generate the data indicating the fullness of the compactor, the number of remaining uses, and when the compactor is estimated to be full. Clearly, in such a system, the central processor can generate fullness data based on the data received from a number of different monitoring units that are connected to it.

Also, the monitoring unit 24 may be provided with other mechanisms for reporting the data it receives and the data it generates to the dispatcher or persons responsible for tending to the waste container 20. As implied above, the monitoring unit may be provided with a modem and autodialer to automatically forward the data to a central processor over the public service telephone network. Alternatively, the monitoring unit can be provided with an autodialing system that causes a page to broadcast. Internal to the page is a message that identifies the facility at which the paging monitoring unit 24 is located and a code that indicates the container 20/compactor 22 state that requires operator attention. Likewise, it should be recognized, that the monitoring unit 24 may be provided with more than one communication device. For example, the monitoring unit 24 may provide normal status reports to a central processor over a telephone connection; in the event a critical fault is detected, the monitoring unit will cause a page to broadcast.

Also, there is no need that, in all versions of the invention, each process step be executed precisely as described or in the order set forth. For example, while in most versions of the invention it is desirable not to analyze container fullness based on pressure data acquired during the initial and final extension periods 80 and 84, respectively, of the ram 26, that need not always be the case. Depending on the use patterns of some waste containers 20, the hydraulic pressure acquired during one or both of these periods may be very useful for predicting container fullness.

Also, while in most versions of the invention, it is preferable to base container 20 fullness on the average pressure data, that need not always be the case. Similarly, there is no requirement that the USE_CNT be incremented only after the ram 26 has cycled beyond the initial use period 80. In other versions of the invention, this count may be updated at other times in the process.

Furthermore, other processing steps may be employed to determine the maximum uses of the container 20. For example, each time the container 20 is removed a pressure/use value may be calculated and stored. These individual pressure/use values can then be averaged to serve as the PPUA value upon which the maximum container uses is calculated. Alternatively, the average of these individual values and the average of the summation-based pressure/use average discussed above with respect to step 124 may be averaged together so that the result of that averaging serves as the PPUA value upon which container use is based.

Likewise, there is no need that, in each version of the invention the PRCNT_FULL value be based on a 50/50 average of PRCNT-FULL$_{USE}$ and PRCNT_FULL$_{PRS}$. In some versions of the invention PRCNT_FULL may be calculated by weighing one of the above variables more than the other variable or even solely on one of the above variables. Alternatively, the exact formula by which the PRCNT_FULL may vary as the container is filled.

Some versions of the invention may be provided with an electronically-controlled lock unit that is tied to the monitoring unit and/or the compressor control unit 38. These versions of the invention are configured so that, before an individual can actuate the compressor 22, the individual must enter a specific identification code, or pass a specially coded identification card through a complementary reader. The monitoring units of these versions of the invention thus both records not only when the compactor is actuated, by the identity of the person controlling the compactor. This information can be useful for monitoring both compactor use and the persons operating the compactor 22.

It should likewise be understood that the system and method of this invention can be employed with container-compactor assemblies that employ mechanisms other than hydraulically operated rams to compress waste. These versions of the invention monitor a parameter other than hydraulic pressure to obtain a measure of the force the compacting unit employs to compress compactor waste. For example, it may be possible to monitor the current drawn by the electric motor that actuates that ram or motor torque in order to obtain data representative of the force required to compress the waste.

Furthermore, not all versions of this invention may be configured to generate data representative of when a container will be full at a future time. Therefore, it is the object of the appended claims to cover all such variations and modifications as come within the true spirit and scope of the invention.

The embodiments of the invention in which an exclusive property or privilege is claimed are defined as follows:

1. A system for monitoring the fullness of a waste container, wherein a ram is employed to compress the waste in the container, said system including:

a first sensor configured to detect when the ram is actuated, said first sensor providing a ram actuation signal;

a second sensor to measure the force required to actuate the ram, said second sensor providing a force signal;

a third sensor for monitoring the presence of a container, said third sensor providing an empty container signal when a container is separated from the ram; and a processor unit connected to receive the ram actuation signal, the force signal and the container empty signal, said processing being configured to:

count how often the ram is actuated after the container is emptied;

determine from the force signal the highest force required during the use of the ram to compress the waste and store data representative of the highest force as a current force value;

calculate a pressure/use value for the container, wherein after said container empty signal indicates a container is emptied, the pressure/use value is calculated by dividing the current force value by the count of how often the ram was actuated prior to the container being emptied;

calculate a maximum uses value representative of the number of times the container can be used based on the pressure/use value; and calculate the fullness of the container based on the count of ram actuations and the maximum uses value.

2. The system of claim 1, wherein said processor is further configured to calculate the fullness of the container by first comparing the count of ram actuations to the maximum uses value and a second comparison of the current force value to a set maximum force value, the maximum force value being representative of the maximum force used to actuate the ram, and generating a value representative of the fullness of the container based on both the first and second comparisons.

3. A method of evaluating the fullness of a waste container wherein a compactor is employed to compress the waste in the container, said method including the steps of:

providing: a first sensor that is attached to the compactor for monitoring the force required to actuate the compactor; a second sensor to detect when the compactor is actuated; and a processor;

measuring with the first sensor the force required to actuate the compactor to compress the waste and storing data representative of the force in the processor;

monitoring with the second sensor when the compactor is actuated and storing data representative of a count of the number of times the compactor is actuated in the processor;

after a full container is removed and replaced with a new container, calculating with the processor a force-per-use value for the container based on the force required to actuate the compactor immediately prior to removal of the full container and the number of times the compactor was actuated prior to removal of the container;

calculating with the processor a maximum use value for the container based on the force-per-use value and a maximum force value representative of a maximum force that can be applied to the compactor; and after subsequent actuations of the compactor to compress waste in the new container, calculating a $PRCNT_FULL_{USE}$ value representative of container fullness with the processor based on the count representative of the number of times the compactor was actuated to compress waste in the new container and the maximum use value.

4. The method of evaluating the fullness of a waste container of claim 3, further including the steps of:

after the subsequent actuations of the compactor to compress waste in the new container, calculating a $PRCNT_FULL_{PRS}$ value representative of container fullness with the processor based on the data representative of the force last used to actuate the compactor and the maximum force value; and averaging the $PRCNT_FULL_{USE}$ value and the $PRCNT_FULL_{PRS}$ value with the processor to calculate a PRCNT_FULL value representative of container fullness.

5. The method of evaluating the fullness of a waste container of claim 4, during said step of averaging the $PRCNT_FULL_{USE}$ value and the $PRCNT_FULL_{PRS}$ value to calculate the PRCNT_FULL value, the $PRCNT_FULL_{USE}$ value and the $PRCNT_FULL_{PRS}$ value are averaged so that one of the values is weighted more than the other of the values.

6. The method of evaluating the fullness of a waste container of claim 4, wherein:

said step of measuring the force required to actuate the compactor comprises the following steps:

measuring with the first sensor the force required to actuate the compactor for a plurality of actuations of the compactor and storing the data representative of the measured force for the plurality of actuations; and averaging the forces required to actuate the compactor for the plural actuations of the compactor with the processor to calculate a current force value; and wherein the current force value is used in said step of calculating the force-per-use value to calculate the force-per-use value and in said step of calculating the $PRCNT_FULL_{PRS}$ value to calculate the $PRCNT_FULL_{PRS}$ value.

7. The method of evaluating the fullness of a waste container of claim 4, wherein:

after each full container is removed and replaced, storing in the processor data representative of the force required to actuate the compactor immediately prior to removal of the full container and the number of times the compactor was actuated; and after a plurality of full containers are removed and replaced, the processor performs said step of calculating the force-per-use value based on the stored data representative of the forces required to actuate a ram of the compactor for the plurality of containers and the data representative of the number of times the compactor was actuated for each container.

8. The method of evaluating the fullness of a waste container of claim 3, wherein:

the compactor is actuated to compress the waste in the container in a primary extension period and in a final extension period that immediately follows the primary extension period; and in said step of storing the data representative of the force required to actuate the compactor, the processor only stores data representative of a maximum force required to actuate the compactor during the primary extension period.

9. The method of evaluating the fullness of a waste container of claim 3, wherein:

the compactor is actuated in order to compress the waste in the container in an initial extension period and in a primary extension period that immediately follows the initial extension period; and in said step of storing the data representative of the force required to actuate the compactor, the processor only stores data representative of a maximum force required to actuate the compactor during the primary extension period.

10. The method of evaluating the fullness of a waste container of claim 3, wherein:

said step of measuring the force required to actuate the compactor comprises the following steps:

measuring with the first sensor the force required to actuate the compactor for a plurality of actuations of the compactor and storing the data representative of the measured force for the plurality of actuations; and averaging the forces required to actuate the compactor for the plural actuations with the processor to calculate a current force value; and wherein the current force value is used in said step of calculating the force-per-use value to calculate the force-per-use value.

11. The method of evaluating the fullness of a waste container of claim 3, wherein:

after each full container is removed and replaced, storing in the processor data representative of the force required to actuate the compactor immediately prior to removal of the full container and the number of times the compactor was actuated; and after a plurality of full containers are removed and replaced, the processor performs said step of calculating the force-per-use value based on the stored data representative of the forces required to actuate the compactor for the plurality of containers and the data representative of the number of times the ram was actuated for each container.

12. The method of evaluating the fullness of a waste container of claim 11, wherein:

said step of measuring the force required to actuate the compactor comprises the following steps:

measuring with the first sensor the force required to actuate the compactor for a plurality of actuations of the compactor and storing the data representative of the measured force for the plurality of actuations; and averaging the forces required to actuate the compactor for the plural actuations with the processor to calculate a current force value; and wherein the current force value is used in said step of calculating the force-per-use value to calculate the force-per-use value.

13. The method of evaluating the fullness of a waste container of claim 3, wherein:

hydraulic force is used to actuate a ram of the compactor; and said step of measuring the force required to actuate the ram comprises monitoring the pressure of a hydraulic fluid used to supply the force used to actuate the ram.

14. The method of evaluating the fullness of a waste container of claim 3, wherein:

a third sensor is provided for monitoring when the container is removed and replaced with the new container, wherein the sensor provides a signal to the processor when the container is removed and replaced; and the processor performs said step of calculating the force-per-use value upon receiving the signal from the third sensor that the container is removed and replaced.

15. The method of evaluating the fullness of a waste container of claim 3, further including the steps of:

monitoring with the first sensor and the processor when the compactor is actuated so as to maintain a count for at least one time interval of the number of times the compactor is used in the at least one time interval;

calculating with the processor an average usage value for the compactor for the at least one time interval, said average usage value calculation based on the count obtained of how often the compactor was actuated during a plurality of successive ones of the at least one time interval;

after the subsequent actuations of the compactor to compress waste in the new container, calculating with the processor the remaining uses of the container with the processor based on the count representative of the number of times the compactor was actuated to compress waste in the new container and the maximum uses value; and determining when the container will be full by subtracting from the calculated remaining uses of the container the average usage value of the container from the current time for consecutive time intervals thereafter until a remainder of said subtractions falls to zero, the time interval in which the remaining uses falls to zero being the time interval at which the container is predicted to be full.

16. The method of predicting when a waste container will be full of claim 15, wherein a plurality of average use values for the compactor are calculated for a plurality of different, chronologically sequential time intervals.

17. The method of predicting when a waste container will be full of claim 16, wherein the time intervals are one from the group consisting of: days; hours; work shifts; and production cycles.

18. A system for determining the force required to compress material in a waste container with a compaction ram, said system including:

a sensor for monitoring force required to actuate the compaction ram throughout a compaction cycle, said sensor configured to generate a sensor signal representative of the actuation force; and a processor connected to receive the sensor signal, said processor configured to: sample the sensor signal for a time period that is less than a total time of the compaction cycle in which the ram is actuated; and, from the sampled sensor signal, determine the signal representative of the highest force require to actuate the ram.

19. The system of claim 18, wherein said processor is configured so that the time period for which the sensor signal is sampled terminates before the end of the compaction cycle.

20. The system of claim 19, wherein said processor is configured so that the time period for which the sensor signal is sampled begins after the time at which the compaction cycle starts.

21. The system of claim 18, wherein said processor is configured so that the time period for which the sensor signal is sampled begins after the time at which the compaction cycle starts.

22. The system of claim 18, wherein: the ram is actuated with a hydraulic fluid; and said sensor is configured to measure the pressure of the hydraulic fluid.

23. A method of determining the force required to compress waste in a container wherein, a compactor is actuated for a period of time to compress the waste, said method including the steps of:

providing: a sensor to measure force required by the compactor to compress the waste; and a processor connected to the sensor to receive data from the sensor representative of the force required by the compactor;

when the compactor is actuated, measuring the force required by the compactor with the sensor;

determining with the processor the highest force required by the compactor wherein the processor determines the highest force required by the compactor over a time period that is less than a complete time period in which the compactor is actuated and storing data representative of the highest force in the processor; and performing said step of determining the highest force required by the compactor for a plurality of actuations of the compactor and said step of storing data representative of the highest force required by the compactor for the plurality of actuations; and averaging with the processor the data representative of the highest force required by the compactor for the plurality of actuations of the compactor to determine the force required to actuate the compactor.

24. The method of determining the force required to compress waste of claim 23, wherein, in said step of determining the highest force, the time period for which the processor determines the highest force required to actuate the compactor terminates before the time at which the compactor stops compressing waste.

25. The method of determining the force required to compress waste of claim 24, wherein, in said step of determining the highest force, the time period for which the processor determines the highest force required to actuate the compactor begins after the time at which the compactor starts to compress waste.

26. The method of determining the force required to compress waste of claim 23, wherein, in said step of determining the highest force, the time period for which the processor determines the highest force required to actuate the compactor begins after the time at which the compactor starts to compress waste.

27. The method of determining the force required to compress waste of claim 23, wherein: hydraulic fluid is used to actuate the compactor; and in said step of measuring the force required to by the compactor, the sensor measures the pressure of the hydraulic fluid.

28. The method of determining the force required to compress waste of claim 23, wherein:

the compactor includes a ram that is actuated to compress the waste and, each time the compactor is actuated, the ram is actuated a plural number of times;

in said step of measuring the force required by the compactor, the force used to actuate the ram is measured; and in said step of determining the highest force, for each actuation of the compactor, the processor determines the highest force to actuate the ram for a single one of the actuations of the ram.

29. A method of evaluating the fullness of a waste container wherein a compactor is employed to compress the waste in the container, said method including the steps of:

providing: a sensor to measure the force required by the compactor to compress the waste; and a processor connected to the sensor to continually receive data from the sensor representative of the force required by the compactor;

during each time period the compactor is extended, measuring the force required to compact the waste with the sensor and, with the processor, determining from the sensor data the highest force required to compact the waste for a primary extension period that is within and less than a total time period that the compactor is extended; and calculating a PRCNT_FULL value representative of container fullness with the processor based on the highest force last required to extend the compactor and a maximum force value representative of a maximum force that can be used to extend the compactor.

30. The method of evaluating the fullness of a waste container of claim 29, wherein:

said steps of measuring the force required to actuate the compactor and determining the highest pressure required to actuate the compactor are performed for a plurality of extensions of the compactor;

after the plurality of compactor extensions, said processor determines an average force value from the plurality of highest forces; and and said calculation of the PRCNT_FULL value is performed based on the average force value and the maximum force value.

31. The method of evaluating the fullness of a waste container of claim 29, wherein:

the sensor continually performs said step measuring the force required to extend the compactor during the time period the compactor is extended; and the processor continually receives data from the sensor representative of the force measured by the sensor;

in said step of determining the highest measured force, the processor determines the highest force based only on the data received during the primary extension period.

32. The method of evaluating the fullness of a waste container of claim 29, wherein the primary extension period in which the processor determines the highest force begins after the compactor is initially extended.

33. The method of evaluating the fullness of a waste container of claim 29, wherein the primary extension period in which the processor determines the highest force ends before extension of the compactor is terminated.

34. A system for determining the fullness of a waste container, wherein a compactor compresses refuse in the waste container in a compaction stroke, said system including:

a compactor state sensor for monitoring when the compactor is actuated to compress the waste, said compactor state sensor generating a compactor state signal representative of when the compactor is in a compaction stroke;

a force sensor connected to the compactor for measuring the force required by the compactor to compress the waste, said force sensor generating a force signal representative of the measured force; and a processor connected to receive the compactor state signal and the force signal, said processor configured to:

determine from said compactor state signal and the force signal a highest force value representative of the highest force employed by the compactor to compress the waste within a primary extension period of the compactor wherein the primary extension period is within a time period required to execute a complete compaction stroke and less than the time period required to execute the complete compaction stroke; and calculate a fullness value for the container representative of the fullness of the container based on the highest force value and a maximum force value, the maximum force value being representative of a maximum force used by the compactor to compress the waste.

35. The system of claim 34, wherein: said processor is further configured so that, prior to the beginning of the primary extension period, the measured force represented by the force signal is not used in the determination of the highest force; and the primary extension period begins after the beginning of the compaction stroke.

36. The system of claim 34, wherein: said processor is further configured so that, after the termination of the primary extension period, the measured force represented by the force signal is not used in the determination of the highest force; and the primary extension period terminates before termination of the compaction stroke.

37. The system of claim 34, wherein:

said processor is further configured to: make a plurality of determinations of the highest force value for a corresponding plurality of compaction strokes of the compactor; and determine a current force value based on a average of the plurality of highest force values; and when said processor calculates the fullness value, the calculation is based on the current force value and the maximum force value.

38. The system of claim 34 wherein said processor is further configured to: determine the time period of the compaction stroke based on the compactor state signal; determine an average time period for the compaction stroke based on the determinations of the time periods for a plurality of compaction strokes; and determine a beginning time and an ending time for the primary compaction period based on the average time period for the compaction stroke.

* * * * *